US006270549B1

(12) United States Patent
Amick

(10) Patent No.: US 6,270,549 B1
(45) Date of Patent: Aug. 7, 2001

(54) DUCTILE, HIGH-DENSITY, NON-TOXIC SHOT AND OTHER ARTICLES AND METHOD FOR PRODUCING SAME

(76) Inventor: Darryl Dean Amick, 3227 Countryman Cir. NW., Albany, OR (US) 97321

( * ) Notice: Subject to any disclaimer, the term of this patent is extended or adjusted under 35 U.S.C. 154(b) by 0 days.

(21) Appl. No.: 09/148,722

(22) Filed: Sep. 4, 1998

(51) Int. Cl.[7] ..... B22F 1/00

(52) U.S. Cl. ..... 75/255; 75/248; 75/352; 420/430; 102/517

(58) Field of Search ..... 75/255, 352, 248; 420/430; 102/517

(56) References Cited

U.S. PATENT DOCUMENTS

| | | | |
|---|---|---|---|
| 1,847,617 | 3/1932 | Alloy . | |
| 2,119,876 | 6/1938 | Corson . | |
| 2,183,359 | 3/1939 | Smithells . | |
| 2,919,471 | 1/1960 | Hechinger . | |
| 2,995,090 | 8/1961 | Daubenspeck | 102/91 |
| 3,123,003 | 3/1964 | Lange, Jr. et al. | 75/228 |
| 3,372,021 | 3/1968 | Forbes et al. . | |
| 3,623,849 | 11/1971 | Benjamin . | |
| 3,785,801 | 1/1974 | Benjamin . | |
| 3,890,145 | 6/1975 | Hivert et al. . | |
| 3,953,194 | 4/1976 | Hartline, III et al. . | |
| 4,027,594 | 6/1977 | Olin | 102/92.4 |
| 4,035,115 | 7/1977 | Hansen . | |
| 4,035,116 | 7/1977 | O'Brien et al. . | |
| 4,138,249 | 2/1979 | Rosof . | |
| 4,274,940 | 6/1981 | Plancqueel et al. . | |
| 4,338,126 | 7/1982 | Vanderpool et al. . | |
| 4,383,853 | 5/1983 | Zapffe . | |
| 4,428,295 | 1/1984 | Urs | 102/448 |
| 4,488,959 | 12/1984 | Agar . | |
| 4,760,794 | 8/1988 | Allen . | |
| 4,780,981 | 11/1988 | Hayward | 43/44.89 |
| 4,784,690 | 11/1988 | Mullendore | 75/248 |
| 4,881,465 | 11/1989 | Hooper | 102/501 |
| 4,897,117 | 1/1990 | Penrice . | |
| 4,911,625 | 3/1990 | Begg et al. . | |
| 4,931,252 | 6/1990 | Brunisholz et al. . | |
| 4,940,404 | 7/1990 | Ammon et al. . | |
| 4,949,644 | 8/1990 | Brown | 102/498 |
| 4,949,645 | 8/1990 | Hayward | 102/517 |
| 4,958,572 | 9/1990 | Martel . | |
| 4,960,563 | 10/1990 | Nicolas . | |
| 4,961,383 | 10/1990 | Fishman et al. . | |
| 4,990,195 | 2/1991 | Spencer et al. . | |
| 5,049,184 | 9/1991 | Harner et al. | 75/246 |
| 5,069,869 | 12/1991 | Nicolas et al. . | |
| 5,088,415 | 2/1992 | Huffman | 102/515 |
| 5,127,332 | 7/1992 | Corzine et al. | 102/509 |
| 5,175,391 | 12/1992 | Walters et al. | 102/307 |
| 5,237,930 | 8/1993 | Bélanger et al. | 102/529 |
| 5,264,022 | 11/1993 | Haygarth | 75/255 |
| 5,279,787 | 1/1994 | Oltrogge | 419/38 |
| 5,399,187 | 3/1995 | Mravic | 75/228 |
| 5,527,376 | 6/1996 | Amick | 75/246 |
| 5,535,679 | 7/1996 | Craddock | 102/494 |
| 5,713,981 | 2/1998 | Amick | 75/340 |
| 5,719,352 | 2/1998 | Griffin | 102/517 |
| 5,740,516 | 4/1998 | Jiranek, II | 428/553 |
| 5,760,331 | 6/1998 | Lowden et al. | 102/506 |
| 5,786,416 | 7/1998 | Gardner | 524/440 |
| 5,814,759 | 9/1998 | Mravic et al. | 102/517 |
| 5,820,707 | 10/1998 | Amick et al. | 148/669 |
| 5,831,188 | 11/1998 | Amick et al. | 75/246 |
| 5,868,879 | 2/1999 | Amick et al. | 148/669 |
| 5,877,437 | 3/1999 | Oltrogge | 75/228 |
| 5,905,936 | 5/1999 | Fenwick et al. | 419/2 |
| 5,912,399 | 6/1999 | Yu et al. | 75/351 |
| 5,913,256 | 6/1999 | Lowden et al. | 75/248 |
| 5,917,143 | 6/1999 | Stone | 102/506 |
| 5,922,978 | 7/1999 | Carroll | 75/240 |
| 5,950,064 | 9/1999 | Robinson et al. | 419/47 |
| 5,963,776 | 10/1999 | Lowden et al. | 419/64 |

FOREIGN PATENT DOCUMENTS

| | | | |
|---|---|---|---|
| 521944 | | 2/1956 | (CA) . |
| 731237 | | 12/1953 | (GB) . |
| 2149067 | * | 6/1985 | (GB) . |
| 52-68800 | | 6/1977 | (JP) . |
| 59-6305 | | 1/1984 | (JP) . |
| 1-142002 | | 6/1989 | (JP) . |

OTHER PUBLICATIONS

*Gun Tests* Jan. 1998 "Steel 3–inch Magnum Loads Our Choice" pp. 25–27.

*Outdoor Life* J. Carmichel Apr. 1997 "Heavy Metal Showdown" pp. 73–78.

*American Hunter* Jan. 1997 "Federal's New Tungsten Pellets" pp. 18–19, 48–50.

* cited by examiner

*Primary Examiner*—Ngoclan Mai
(74) *Attorney, Agent, or Firm*—Kolisch, Hartwell, Dickinson, McCormack & Heuser

(57) ABSTRACT

Ductile, high-density, non-toxic W—Ni—Mn—Fe alloy compositions and methods of manufacture by which they may be converted to shot (for use in shotshells) and other useful products traditionally made of lead alloys are presented. Product of the present invention is softer than gun barrel steels and may be hand-loaded (and recycled/reloaded) into shotshells using conventional powders, primers, casings and wads. If desired for game law enforcement, shot of the present invention may be formulated to be ferromagnetic while retaining all other desirable attributes.

30 Claims, 1 Drawing Sheet

DUCTILE, HIGH-DENSITY, NON-TOXIC SHOT AND OTHER ARTICLES AND METHOD FOR PRODUCING SAME

BACKGROUND—Field of Invention

This invention relates to metallic shot with improved properties for use in hunting or shooting, and to other articles traditionally made of lead alloys.

BACKGROUND—Description of Prior Art

Because the use of traditional lead (Pb) shot has been outlawed for waterfowl hunting in the U.S., Canada, UK and other countries, much effort has been devoted to identifying a suitable substitute. To be fully satisfactory, alternative shot must possess the following attributes:

a) The material should have density similar to that of lead (Pb) shot, typically 11.0 g/cm$^3$.

b) The material must not cause physiological problems in wildlife which may ingest spent shot from the ground or water.

c) The material must not cause significant damage to shotgun barrels.

d) Shot must possess sufficient strength, rigidity and toughness to adequately withstand "set-back" forces associated with firing and to penetrate the target effectively without shattering or excessively deforming.

e) For purposes of game law enforcement, shot material should preferably be magnetic to easily differentiate it from illegal lead shot.

f) Material used for shot must be economical to obtain and fabricate into spherical product.

None of the alternative shot types currently available conforms to all of the above criteria. Current products in the USA include shot made of steel, bismuth alloy, iron-tungsten alloy and tungsten-polymer composite. Each of these will be reviewed and critiqued in the following discussion, followed by a review of other prior art which has not yet become commercialized.

Steel Shot

The most widely used alternative shot is carbon steel, in spite of the fact that its density is quite low (about 7.9 g/cm$^3$) in comparison with that of lead shot (about 11.0 g/cm$^3$). Inarguable principles of physics and engineering establish that an object of lower density, when moving through a fluid (such as air), will carry less energy at any given velocity, and experience more rapid loss of velocity (due to drag forces) than an object of higher density of the same size and shape. Shotshell manufacturers have employed special powders to increase steel shot velocity, in an attempt to ameliorate its inferior ballistic properties. The "hotter" powders unfortunately create higher pressures within the gun barrel. Safety considerations have therefore prompted shotshell manufacturers to recommend that steel shells only be fired in certain types of modern, high-strength shotguns.

There is also a significant negative impact of steel shot on the very same wildlife which the outlawing of lead is intended to preserve. The inferior ballistics of steel shot, in the hands of the general public, has resulted in higher rates of "crippling" shots. The January, 1997 issue of *American Hunter* refers to "Goose hunters frustrated by steel's inability to kill big birds cleanly. . . . " Generations of hunters accustomed to shooting traditional lead shot tend to attempt to shoot waterfowl at the same distances as they have always considered to be "in range." Another approach taken by steel shotshell manufacturers has been to simply substitute larger steel shot for traditional lead shot sizes, in order to provide equivalent mass.

This practice has the obvious disadvantage that there are fewer shot in any given shell. The "pattern density" of the cloud of shot is lower at any given distance from the point of firing. This sparse pattern again increases the probability that birds will be crippled, rather than harvested for consumption. In summary, a statement by the Shooting Editor of *Outdoor Life Magazine,* Jim Carmichel, is quoted: " . . . steel shot has generally been considered only a quick fix in the search for the ultimate shot pellet." (April, 1997 issue, page 73.)

Bismuth Shot (U.S. Pat. No. 4,949,644 to Brown)

Bismuth alloy shotshells are currently marketed in the USA at approximately three times the cost of steel shells, an indication of how desperate consumers are to obtain improved performance. Unfortunately, bismuth alloys are not equivalent to lead in density (about 9.4 g/cm$^3$ vs 11.0 g/cm$^3$), although somewhat more dense than steel (7.9 g/cm$^3$). In addition to this shortcoming, bismuth alloys are inherently brittle and therefore tend to fracture and disintegrate upon impact (January, 1998 issue of *Gun Tests*). As fracture surfaces form in the shot, energy is lost which would otherwise be available to enhance penetration of the target. In this instance, it is even likely that all the increased energy gained by having higher density than steel is lost as fracture occurs. Finally, it should be noted that bismuth is non-magnetic and cannot be readily distinguished from illegal lead shot by game officers in the field.

Iron-Tungsten Shot (U.S. Pat. Nos. 5,264,022; 5,527,376; 5,713,981 assigned to Teledyne Industries, Inc.)

A more recent product which began to be marketed in the USA in 1997 is a shotshell containing binary iron-tungsten alloy shot (60%Fe-40%W, by weight). Because the Fe—W is very hard (about Rockwell C50), and therefore must be ground with ceramic abrasives (alumina, silicon-carbide, diamond, etc.), particles of which become imbedded in the shot surface, this type of shot will result in severe damage in all gun barrels unless the shot is encapsulated in a special "overlapping double-wall" plastic shot-cup of heavy construction. Even with this precautionary design, the manufacturer prints a clear message on each box of product disclaiming any responsibility for gun barrel damage or personal injury. Although controversial, one current theory is that it is possible for a few shot to rebound forward out of the plastic cylinder upon firing and to thereby contact the unprotected steel barrel. The consequences of forming longitudinal scratches in the barrel are that stresses produced by the expanding explosive gases will be concentrated in the regions around the scratches. A primary concern is that these stresses may be sufficiently high to cause catastrophic bursting of the barrel.

Whether adequately protective or not, the special plastic shot-cup (or "wad") creates another significant problem. The wad must be made of plastic tubing so thick as to make it impossible to load quantities of shot equivalent to those of traditional lead shells. For example, Fe—W shells of 2¾-inch length for 12-gauge guns contain only 1.0 ounce of shot versus 1⅛ to 1¼ ounces in corresponding lead or steel shells. The deficient pellet numbers result in correspondingly sparse pattern densities, the same problem encountered in substituting larger steel shot for traditional lead sizes, as mentioned previously.

Although more dense than bismuth shot, Fe—W shot currently marketed is still considerably less dense than lead shot (about 10.2–10.5 g/cm$^3$ vs 11.0 g/cm$^3$). When this fact is combined with the lower pattern densities, the purported advantages of Fe—W shot over steel shot become questionable.

Finally, problems associated with manufacturability, and their adverse effects on product cost, are relatively severe. The constituent phases in Fe—W alloys cause the shot to be so hard and brittle as to be impossible to forge or swage these alloys into rods, or even to shape them compressively into spheres. Although the referenced patents claim Fe—W shot can be made by casting, the inherent brittleness and high melting temperatures of these alloys caused cracking to occur during rapid cooling. Cracking also plagued the process of compressive grinding, which was tried as a means of rounding the generally asymmetrical shot. Consequently, the shot actually being produced and marketed must be made by an expensive powder metallurgical method. Even with this approach, only larger shot sizes ("BB" 0.180-inch-diameter, and "#2" 0.150-inch-diameter) are being produced at present. This is due to the fact that powder processing costs increase exponentially as shot sizes decrease. Furthermore, the fragility of compaction tooling becomes a limiting factor as shot size decreases. Shot sizes #4 (0.130-inch), #5 (0.120-inch), #6 (0.110-inch) and #7½ (0.095-inch) traditionally preferred for hunting all but the very largest game birds (such as geese), are unavailable for these reasons.

Attempts to increase Fe—W shot densities to be equivalent to lead shot are frustrated by the fact that elevating tungsten content not only raises material costs but further exacerbates fabricability problems. As in the case of bismuth shot, Fe—W shells are about three times as expensive as steel shells, thereby rendering them unaffordable by the average sportsman. Unlike steel shot, which can be obtained by the average citizen to reload his own sporting ammunition, Fe—W shot and the special plastic wads which make it allegedly safe to use have not been made available to the public for reloading (April/May, 1995 issue of *Wildfowl Magazine).*

Tungsten-Polymer Shot

A new version of an older idea (U.S. Pat. No. 4,949,645 to Hayward et al) is currently proposed for the U.S. market in 1998–1999 (January/February, 1995 issue of *Ducks Unilimited Magazine* and March, 1998 issue of *Petersen 's Shotguns).* This shot material is a composite of tungsten powder and a powdered polymer (e.g., nylon, polyethylene, et al). Mixtures of these two constituents are formed into spheres of cured composite, the polymer "glue" being the continuous phase and the tungsten powder particles the discontinuous phase. By virtue of its weak polymer-to-metal bonds, the material will reportedly not damage gun barrels. It is this very "weakness", however, which is one of the undesirable features of tungsten-polymer shot. Rigidity and strength are important material properties which affect the ability of shot to (1) penetrate the target effectively, and (2) remain spherical during launching and flight.

The penetrability factor can be easily understood by considering the behavior of a rubber bullet (used, for example, by police). The projectile does not penetrate well because its kinetic energy is absorbed and dissipated by its own deformation. Rigidity, as used here, is measured by a material property value known as elastic modulus. Because the elastic moduli of all organic polymers are far lower than those of metals, the subject composite materials are, as expected, less rigid than steel, Fe—W, et al. The second factor is important when a different type of shot distortion/deformation occurs which causes loss of sphericity, thereby degrading shot pattern density and uniformity. During firing, the shot experiences high compressive "set-back" forces. Materials which are relatively weak (i.e., low in yield strength), undergo various degrees of permanent distortion, referred to as "plastic deformation." Any loss of sphericity will result in erratic flight paths of shot and will therefore produce undesirable pattern uniformty.

Another disadvantage of tungsten-polymer shot is one of economics. Because polymers are much lower in density than common metals such as iron, a composite density equivalent to that of lead shot (11.0 g/cm$^3$) can only be attained by using high concentrations (e.g., 95%) of costly tungsten powder.

As in the case of bismuth, tungsten-polymer shot is non-magnetic, making it difficult for law enforcement to distinguish it from illegal lead shot.

OTHER PRIOR ART

A number of proposed alternative shot materials demand the use of expensive powders as input to processes which include mixing, pressing, sintering and sizing. These processes are expensive and difficult to control, beginning with the challenge of characterizing the input powder particle sizes, distributions and shapes. Many of these processes require the use of special atmospheres such as hydrogen or vacuum to protect constituents such as tungsten powder against oxidation during high-temperature processing. Alternative shot materials in this category include U.S. Pat. No. 5,279,787 to Oltrogge, U.S. Pat. No. 5,399,187 to Mravic et al, and U.S. Pat. No. 4,784,690 to Mullendore et al. As in the case of Fe—W shot, such processes can, at the most, only be expected to be economically feasible for the larger shot sizes, which have limited usefulness.

Other proposed shot materials include significant concentrations of lead as a specified ingredient. Recent rulings by the U.S. Fish and Wildlife Service have outlawed the use of any shot material containing more than 1.0% lead. This action has eliminated consideration of proposed materials described in a variety of U.S. Patents: U.S. Pat. Nos. 2,995,090 and 3,193,003 to Daubenspeck; 4,027,594 to Olin; 4,428,295 to Urs; 4,881,465 to Hooper; and 5,088,415 to Huffman et al are examples.

Even materials which are lower in density than steel have been proposed for alternative shot. Examples are zinc (7.14 g/cm$^3$) and tin (7.3 g/cm$^3$), the latter being reported in the Sep. 4, 1997 issue of *American Metals Market.* Such materials certainly offer no improvement in ballistic properties over those of steel shot.

Finally, a general criticism which can be made for all so-called "high-density, non-toxic" shotshells presently available to the public is that they are approximately three times as expensive as even "premum grade" steel shotshells. This fact discourages the average hunter from actually purchasing these products, thereby frustrating agencies and individuals who are attempting to find a suitable substitute for traditional shot. One of several preferred objectives of the present invention is to place emphasis on materials and processes which are more economical than those required by other non-toxic, high-density shot options.

OBJECTS AND ADVANTAGES

Accordingly, the present invention addresses and solves each of the problems associated with other alternative shot types. Several objectives of the present invention are:

a) to provide a shot material which, unlike Fe—W alloys, is castable and formable and therefore able to be manufactured by conventional processes, b) to provide a shot material which, unlike Bi and Fe—W products currently available, is fully as dense as lead alloy (11.0 g/cm$^3$) or higher, c) to provide a shot material which, unlike Fe—W and high-carbon steel, is much softer than gun barrel steels, thereby reducing or eliminating damage, d) to provide a shot material which is non-toxic to wildlife and the environment, e) to provide a shot material which, if desired, can be made magnetic for game-law purposes, unlike Bi and tungsten-polymer, f) to provide a tough shot material which will not fracture or disintegrate upon impact, g) to provide a shot material which, unlike Bi, tungsten-polymer and low-carbon steel, is strong enough to withstand firing without distorting (but soft enough to minimize gun barrel damage), h) to provide a shot material which, by virtue of its softness, is suitable for use with conventional plastic wads used for low-carbon steel, thereby making it possible for private parties to load and use it, and i) to provide a s hot material which, by virtue of its ferromagnetic properties, may be readily salvaged for reuse, unlike Bi and tungsten-polymer shot.

A further objective is to provide a shot material which, because it may be salvaged and reused, will enable groups and individuals to offset initial shot costs by recycling. This will allow W-containing shot to be economical for recreational shooting (e.g., trap, skeet, and sporting clays). Devices and methods for performing the actual salvage operations are also suggested in the present invention.

Still further, a shot material ultimately is provided which, in its preferred embodiment of alloy melting, casting, and fabrication, can use virtually any source of tungsten as input material. This includes, but is not limited to, virgin tungsten, scrap tungsten, ferrotungsten, tungsten alloys, tungsten-carbide, et al. It also includes a novel consideration of utilizing a unique, less-expensive type of ferrotungsten directly reduced from forms of the mineral "wolframite", $(FeMn)WO_4$.

A primary overall objective of the present invention, which makes it possible to attain objectives (a) through (i), is to produce tungsten alloys for shot which, unlike iron-tungsten alloys, are castable and ductile enough to be formable by conventional processes and equipment, and which can utilize less expensive sources and types of W. Toward this end, a scientific approach, using sound principles of metallurgy and physics, has been used to solve a specific set of problems.

DRAWINGS FIGURES

SUMMARY

Figure 1:
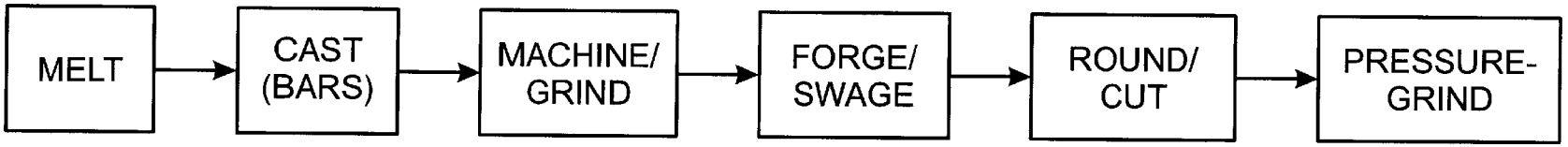
FIG. 1 shows the processing steps required to convert raw materials to spherical shot by forging cast alloy bar.

In accordance with the present invention, methods for making ductile, high-density, non-toxic shot and other articles traditionally made of lead alloys are presented comprising melting and casting articles of 30–75% W, 10–70% Ni, 0–35% Fe (with Ni:Fe≧1.0) and 0–20% Mn (with Ni:Mn≧2.0), followed by forging/swaging and finishing by machining and/or compressive grinding.

DESCRIPTION—FIGS. 1–4

It has been unexpectedly found that shot alloys containing 30–75% W with additions of Ni, Mn and Fe in certain specified proportions are castable and relatively soft, ductile, and formable. The alloys of the present invention have densities of 10.5–15g/cm$^3$ and may be formulated to have ferromagnetic properties (or not, as desired). Significant degrees of ductility and softness allow these alloys to be fabricated to finished products not only by conventional processes such as shot-drop casting and near-net-shape mold casting, but also by converting cast ingots into forged product forms such as rod, wire, spheres, etc. Such forged products may further be reduced in size and refined in shape by compressive grinding processes, without shattering, cracking, or spalling. Furthermore, shot products of the present invention are much softer than any conventional gun barrel steel and will therefore minimize barrel scoring and wear.

Alloys containing tungsten (W) as a major constituent to impart increased density were made to be ductile by including metallurgically appropriate amounts of nickel (Ni), iron (Fe) and/or manganese (Mn). Ni and Mn are notable for, among other factors, their ability to stabilize the high-temperature "gamma" phase of ferrous alloys (a crystal form referred to as "austenite"). Accordingly, a range of alloys of Ni, Mn, Fe and W were produced and evaluated.

EXAMPLE 1

Vacuum arc-melted (TIG) buttons (100 g each) of three different alloys (Table 1) were prepared using the following input materials:

Pure W sheet (⅛" thick) or powder (−325 mesh)

Carbonyl Ni pellets (⅛"–¼" diameter)

Electrolytic Mn (flakes)

Pure Fe (−150 mesh powder)

TABLE 1

| | Compositions | | | |
|---|---|---|---|---|
| Alloy | Ni, wt. % | Mn, wt. % | Fe, wt. % | W, wt. % |
| 1 | 25 | 0 | 25 | 50 (powder) |
| 2 | 33.3 | 0 | 16.7 | 50 (powder) |
| 3 | 16.7 | 16.6 | 16.7 | 50 (sheet) |

During melting, it was observed that gas evolution occurred on the two buttons with W powder input, while the W sheet used for Alloy 3 did not totally dissolve. Nevertheless, the buttons proved to be ductile as indicated by filing, stamping, and bending by a hammer in a vice. A decision was made to repeat this experiment using a different form of tungsten as input.

EXAMPLE 2

The alloys of Table 1 ( 100 g each) were again prepared in the same way, but using −150 mesh ferrotungsten (80%W - 20%Fe) instead of pure W. Melting was much improved and complete dissolution of the ferrotungsten was achieved. During melting, it was observed that the Mn-bearing alloy was not as fluid as the other alloys. The alloy buttons were evaluated by performing Rockwell hardness tests on flat-ground areas of the buttons. Table 2 presents these results.

TABLE 2

Button Hardness

| Alloy | Rockwell B hardness | |
|---|---|---|
| 1 A | 86, 89, 90 | (Ave: 88.3) |
| 2 A | 84, 85, 90, 89, 90 | (Ave: 87.6) |
| 3 A | 91, 90 | (Ave: 90.5) |

Densities were determined by weighing each button and by using water-displacement to estimate its volume. Table 3 presents measured densities for comparison against corresponding values calculated by the "rule-of-mixtures" method:

$$D,\ \mathrm{g/cm^3} = \frac{1\ \mathrm{g}}{\left(\frac{f,\mathrm{Ni}}{8.9} + \frac{f,\mathrm{Mn}}{7.43} + \frac{f,\mathrm{Fe}}{7.86} + \frac{f,\mathrm{W}}{19.3}\right)}$$

where "f" indicates weight fraction of each element, which is then divided by its density in g/cm$^3$.

TABLE 3

Button Density

| Alloy | Measured, g/cm$^3$ | Calculated, g/cm$^3$ |
|---|---|---|
| 1 A | 11.3 | 11.7 |
| 2 A | 12.1 | 11.8 |
| 3 A | 11.8 | 11.3 |

Applying a permanent magnet to the buttons revealed that the ternary alloys (Alloys 1 A and 2 A) were ferromagnetic, whereas the quaternary alloy was non-magnetic. As in Example 1, ductility of the buttons was demonstrated by bending them at room temperature with a hammer and vise.

Two significant findings of these initial experiments were that (1) all three alloys were surprisingly similar in hardness (i.e., all were so soft as to be below the Rockwell C scale normally applicable to low- and high-alloy steels) and that (2) the 16% Mn content was high enough to elimidnate ferromagnetic properties of the alloy. (Both Fe and Ni are ferromagnetic, while W and Mn are not.) As mentioned previously, it is preferable that non-toxic shot be magnetic to allow game officers to easily check shotshells in the field and to allow magnetic collection and subsequent recycling/reloading of spent shot. The importance of including Mn in alloys of the present invention relates to making shot products more affordable to the general public. This is due to the fact that the economically important "wolframite" family of tungsten minerals contains significant amounts of Mn. $FeWO_4$ is called "ferberite", MnWO4 "goethite" and versions of the same mineralogical structure containing both Fe and Mn ($Fe/MnWO_4$) "wolframite." In the production of conventional ferrotungsten (the least expensive form of metallic or "reduced" tungsten), it is standard practice to remove the Mn, at an added cost. In the following experiments, alloys containing Mn concentrations as high as 8.35% were evaluated and found to be ferromagnetic.

EXAMPLE 3

The following alloys were produced from crushed (−¼ inch) ferrotungsten (76% W), iron scrap (0.08% max. C), carbonyl Ni pellets and electrolytic Mn.

TABLE 4

Designed Compositions

| Alloy | W, % | Ni, % | Fe, % | Mn, % |
|---|---|---|---|---|
| A | 50 | 33.3 | 16.7 | 0 |
| B | 50 | 30 | 20 | 0 |
| C | 50 | 30 | 16.7 | 3.3 |
| D | 50 | 30 | 11.65 | 8.35 |

Batches of approximately 85 lb were prepared for each alloy, melted in a 100-lb, 150 -kw induction furnace, and cast at about 1500–1600° C. into "green sand" molds to produce eight bars of each alloy approximately 1.0-inch diameter by 24 inches long. The cast bars were trimmed, abrasively cleaned and machined. (Portions of the molten alloys were also taken for shot-drop casting and near-net-shape casting which are presented later in Examples 4 and 5.)

Table 5 presents chemical compositions (based on actual analyses for tungsten), as-cast Rockwell B hardness, density and results of tests for ferromagnetism.

TABLE 5

Actual Compositions and Properties

| Alloy | W, % | Ni, % | Fe, % | Mn, % | $R_B$ | Magnetic? | Density, g/cm$^3$ |
|---|---|---|---|---|---|---|---|
| A | 48.3 | 33.3 | 18.4 | 0 | 83 | yes | 10.8 |
| B | 48.4 | 30.0 | 21.6 | 0 | 82 | yes | 11.3 |
| C | 48.3 | 30.0 | 18.4 | 3.3 | 83 | yes | 11.0 |
| D | 48.4 | 30.0 | 13.25 | 8.35 | 85 | yes | 10.9 |

One cast bar of each alloy was machined to approximately 0.8-in. dia. and swaged at room temperature in a conventional two-die impact swage. Using incremental diameter reductions of 0.010–0.020 in., all four alloys were successfully reduced by about 30–35% overall reduction-in-area (ROA) before ductility was lost. This degree of reduction was shown to be independent of whether "room-temperature" or "hot" (800° C.) swaging was employed. Although Alloy A actually achieved the largest ROA (35.4%) and Alloy D the smallest (29.4%), the inventor believes these small differences are insignificant. FIG. 1 is a schematic representation of a potential production process based upon the results of this experiment.

EXAMPLE 4

Figure 2:
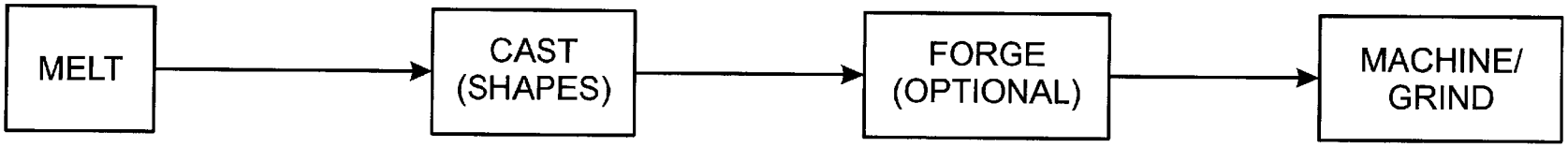
FIG. 2 shows the processing steps required to convert raw materials to finished near-net-shape castings.
Figure 3:
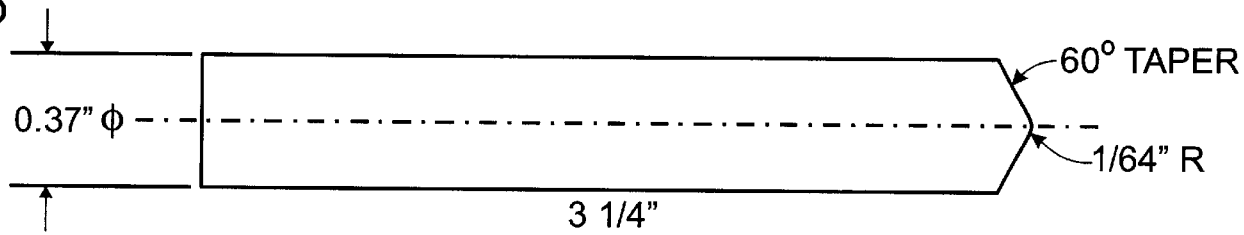
FIG. 3 shows an example of a near-net-shape casting made by the process of FIG. 2.

During the casting phase of Ex. 3, molten samples of all four alloys were directly cast into a variety of near-net shapes/sizes, including the following:

Alloys A, B, C and D were cast in 1"-dia.×1¼" L alumina molds and in 5/32"-dia.×6–12" L. evacuated Pyrex tubes. Alloy B was additionally cast in a graphite mold to produce three bars 0.37"-dia.×3¼" L with conical ends (to simulate bullet shapes). These castings were subjectively evaluated for surface quality, porosity and density, and deemed to be of high quality. FIG. 2 presents a potential production process based upon these results, while FIG. 3 is a drawing of the actual near-net article produced in this example.

EXAMPLE 5

Figure 4:
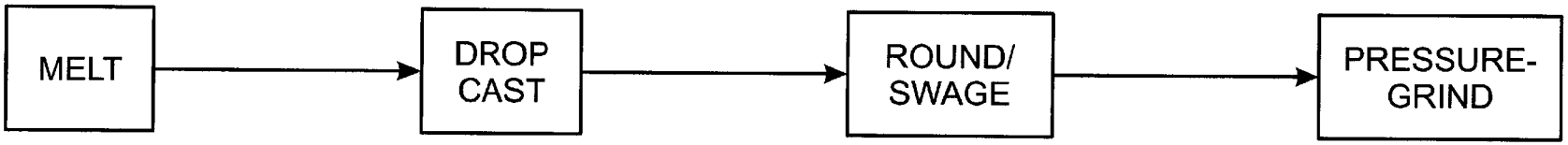
FIG. 4 shows the processing steps required to convert raw materials to spherical shot by drop-casting, followed by swaging and pressure-grinding.

Yet another type of casting ("drop casting", such as is used in shot towers for producing lead shot) was conducted during the melting phase of Ex. 3. Molten alloy samples were poured through ceramic sieves (with apertures of 0.050: dia.) suspended in air about 8.0 inches above the liquid level (18 in.) of a 20-gal. drum containing cold (30° C.) water (in the cases of Alloys A, B and C) or 10% NaCl brine (in the case of Alloy D). The resulting solidified alloy droplets were found to be fully dense (11.3–12.0 g/cm$^3$), unfractured, and so ductile that they could be cold-reduced without cracking to less than half original thickness by impacting with a hammer. These simple experiments were conducted to illustrate the very different behavior of alloys of the present invention and that of binary Fe—W alloys which fracture when cooled rapidly (see U.S. Pat. No. 5,713,981) or when impact-deformed. FIG. 4 presents a potential production process based upon these results.

EXAMPLE 6

To demonstrate that alloys of the present invention may be effectively salvaged, recycled and remelted, 43.4 lb of cast Alloy C bars and 24.4 lb of Alloy A cast scrap were remelted by induction and recast into the following shapes:

2 pcs: 2⅜" dia.×6" in graphite molds 6 pcs: 5/32" dia.×6–12" L, in evacuated Pyrex tubes 1 mold: 3 bars ⅜" dia.×4" L, in graphite mold 1 mold: 4 wires ⅛" dia.×3" L, in graphite mold Surface quality, density, ductility, ferro-magnetism, etc. were found to be equivalent to those of virgin metal (Alloys A–D). The approximate composition of this alloy ("AC hybrid") was:

48.3% W 31.2% Ni 18.4% Fe 2.1% Mn

CONCLUSION, RAMIFICATIONS AND SCOPE

The present invention provides a range of alloy compositions and methods of manufacturing shot ideally suited for use in shotshells as a replacement for traditional lead shot. Shot made in accordance with this invention has the following desirable attributes:

a) It may be formulated to have density equal to that of lead shot, or greater.

b) It is low in toxicity.

c) It possesses sufficient ductility to be forged and swaged, then formed and ground to spheres.

d) It is significantly softer than any gun barrel steel, thereby minimizing damage and/or wear.

e) It may be formulated to be ferromagnetic, thereby making it possible for law enforcement to readily detect illegal lead shot.

f) It possesses yield strength sufficiently high to resist shot distortion, while maintaining relatively low hardness and high ductility.

g) It may be cast into shot and rapidly quenched without cracking.

h) It may be hand-loaded (or reloaded) by private individuals, using conventional powders and wads. Specifically, powders selected could be those traditionally used for lead shot, while wads and shot-cups selected could be varieties normally used for steel shot.

i) It may be magnetically gathered (from a shooting range, for example) and reused/recycled.

j) Because the range of compositions of the present invention may be used to produce densities 10.5–15 g/cm$^3$, shotshells may be loaded with a mixture of different sizes and densities. Provided that the mathematical product of "density times diameter" is some constant value for all shot particles in a cartridge, they will experience the same drag forces in flight and therefore be ballistically similar. (U.S. Pat. No. 5,527,376 claims a mixture of shot in which the product of "density times diameter-squared" is a constant, a combination which does not achieve ballistic equivalency.)

Furthermore, the ease with which alloys of the present invention may be directly cast to near-net shapes, forged, swaged, etc., makes it feasible to manufacture other objects traditionally made of (toxic) lead such as bullets, fishing weights, counterweights, wheel weights, etc.

Thus the scope of the invention should be determined by the appended claims and their legal equivalents, rather than solely by the examples given.

I claim:

1. A method for making ductile, non-toxic spheres and other desired shapes of cast articles with densities 10.5–15 g/cm$^3$ comprising the steps of melting and casting alloys of the following range of composition:

30–75% tungsten,

10–70% nickel,

0–35% iron,

0–20% manganese.

2. The method of claim 1 wherein the following preferred range of composition is selected to obtain ferromagnetic properties:

30–75% tungsten,

20–40% nickel,

10–20% iron, with nickel:iron weight ratio≧1.0,

0–10% manganese, with nickel:iron weight ratio≧2.0.

3. The method of claim 1 further including mechanically deforming said cast article to a desired size and shape.

4. The method of claim 1 further including mechanically sizing said cast article by compressive grinding.

5. The method of claim 3 further including sizing said cast article by compressive grinding.

6. The method of claim 1 wherein ferrotungsten, obtained from reduction of wolframite without intentional removal of manganese, is utilized as an alloy constituent.

7. An article produced by the method of claim 1.

8. An article produced by the method of claim 2.

9. An article produced by the method of claim 3.

10. An article produced by the method of claim 4.

11. An article produced by the method of claim 5.

12. The method of claim 1, wherein the nickel:iron weight ratio in the alloy is ≧1.0.

13. The method of claim 1, wherein the nickel:manganese weight ratio in the alloy is ≧2.0.

14. The method of claim 1, wherein the alloy is selected to be ferromagnetic.

15. The method of claim 1, wherein the alloy is selected to not be ferromagnetic.

16. The method of claim 1, wherein the alloy contains <approximately 8.5% manganese.

17. The method of claim 1, wherein the alloy contains manganese in the range of approximately 8.5% and approximately 16%.

18. The method of claim 7, wherein the article is shellshot.

19. The article of claim 18, wherein said shot is comprised of a plurality of particles of varying shot sizes and densities such that the mathematical product of diameter and density for each particle equals an approximately constant value.

20. A ductile, non-toxic lead substitute formed at least substantially from an alloy comprising:

30–75% tungsten,

10–70% nickel,

0–35% iron, and

0–20% manganese, wherein the alloy contains a nickel:manganese weight ratio≧2.0.

21. A ductile, non-toxic lead substitute formed at least substantially from an alloy comprising:

30–75% tungsten,

10–70% nickel,

0–35% iron, and

0–20% manganese, wherein the alloy includes felnotungsten formed by reduction of wolframite without intentional removal of manganese.

22. A ductile, non-toxic lead substitute formed at least substantially from an alloy comprising:

30–75% tungsten,

10–70% nickel,

0–35% iron, and

0–20% manganese, wherein the alloy comprises <approximately 8.5% manganese.

23. A ductile, non-toxic lead substitute formed at least substantially from an alloy comprising:

30–75% tungsten,

10–70% nickel,

0–35% iron, and

0–20% manganese, wherein the alloy comprises manganese in the range of approximately 8.5% and approximately 16%.

24. A ductile, non-toxic lead substitute formed at least substantially from an alloy comprising:

30–75% tungsten,

10–70% nickel,

0–35% iron, and

0–20% manganese, wherein the alloy comprises approximately 16% manganese.

25. A ductile, non-toxic lead substitute formed at least substantially from an alloy comprising:

30–75% tungsten,

10–70% nickel,

0–35% iron, and

0–20% manganese, wherein the alloy is formed into shellshot, and further wherein said shellshot is comprised of a plurality of particles of varying shot sizes and densities such that the mathematical product of diameter and density for each particle equals an approximately constant value.

26. The article of claim 8, wherein the article is shellshot.

27. The article of claim 9, wherein the article is shellshot.

28. The article of claim 10, wherein the article is shellshot.

29. The lead substitute of claim 20, wherein the alloy is formed into shellshot.

30. The lead substitute of claim 21, wherein the alloy is formed into shellshot.

* * * * *

UNITED STATES PATENT AND TRADEMARK OFFICE

CERTIFICATE OF CORRECTION

PATENT NO. : 6,270,549 B1 
DATED : August 7, 2001
INVENTOR(S) : Darryl Dean Amick It is certified that error appears in the above-identified patent and that said Letters Patent is hereby corrected as shown below:

Column 10,
Line 33, delete “nickel:iron” and insert -- nickel:Mn -- therefor.
Line 61, delete “method” and insert -- article -- therefor.

Column 12,
Line 22, delete “claim 8” and insert -- claim 10 -- therefor.
Line 23, delete “claim 9” and insert -- claim 11 -- therefor.
Line 24, delete “claim 10” and insert -- claim 12 -- therefor.

Signed and Sealed this

Fourth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,270,549 B1
DATED : August 7, 2001
INVENTOR(S) : Darryl Dean Amick It is certified that error appears in the above-identified patent and that said Letters Patent is hereby corrected as shown below:

Column 11,
Line 13, after "wherein the alloy includes" please delete "felnotungsten" and insert -- ferrotungsten -- therefor.

Signed and Sealed this

Third Day of February, 2004

JON W. DUDAS
*Acting Director of the United States Patent and Trademark Office*